United States Patent [19]

Futamura et al.

[11] Patent Number: 4,934,442

[45] Date of Patent: Jun. 19, 1990

[54] DIE CAST HEAT TREATED ALUMINUM SILICON BASED ALLOYS AND METHOD FOR PRODUCING THE SAME

[75] Inventors: Kenichiro Futamura; Keiichiro Otsu, both of Aichi, Japan

[73] Assignee: Taiho Kogyo Co., Ltd., Aichi, Japan

[21] Appl. No.: 355,892

[22] Filed: May 24, 1989

Related U.S. Application Data

[63] Continuation of Ser. No. 207,040, Jun. 15, 1988, abandoned, which is a continuation of Ser. No. 124,438, Nov. 23, 1987, abandoned, which is a continuation of Ser. No. 867,665, May 28, 1986, abandoned.

[30] Foreign Application Priority Data

Jun. 19, 1985 [JP] Japan ..... 60-131656

[51] Int. Cl.[5] ..... B22D 18/02; B22D 27/11

[52] U.S. Cl. ..... 164/76.1; 164/120; 148/3

[58] Field of Search ..... 164/76.1, 120; 148/3, 148/416, 417

[56] References Cited

U.S. PATENT DOCUMENTS 4,336,076 6/1982 Edamura et al. ..... 148/417 X
4,380,261 4/1983 Suzaki et al. ..... 164/120
4,419,143 12/1983 Ito et al. ..... 148/3

FOREIGN PATENT DOCUMENTS 54-153728 12/1979 Japan ..... 164/76.1

*Primary Examiner*—Kuang Y. Lin
*Attorney, Agent, or Firm*—Sughrue, Mion, Zinn, Macpeak & Seas

[57] ABSTRACT

A die cast, heat treated shaped aluminum silicon alloy article consisting essentially of, based on an alloy weight, from 13 to 25 wt % silicon, from 2 to 6 wt % copper, up to 1 wt % magnesium, balance aluminum, said heat treated alloy being formed by the process comprising: subjecting said alloy while in molten condition to a primary pressure die casting at a casting pressure of from about 450 to about 500 kg/cm$^2$ to form a primary pressure die cast product; removing the primary casting pressure from said primary pressure die cast product; prior to the time said aluminum silicon alloy completely solidifies, subjecting said primary pressure die cast alloy to a secondary pressure die casting so as to reduce the volume thereof from about 1.5% to about 3%; heating the thus treated product to a temperature of from about 460° C. to about 520° C. for a period of time of from about 2 to about 10 hours; and rapidly quenching said product to produce said article. The process used to produce the article as also claimed as is the combination of the article in sliding contact with another material having a hardness HV of at least 50.

16 Claims, 3 Drawing Sheets

DIE CAST HEAT TREATED ALUMINUM SILICON BASED ALLOYS AND METHOD FOR PRODUCING THE SAME

This is a Continuation, of application Ser. No. 07/207,040 filed June 15, 1988, which is a Continuation of application Ser. No. 07/124,438 filed Nov. 23, 1987 which is a Continuation of application Ser. No. 06/867,665 filed on May 28, 1986, all abandoned.

BACKGROUND OF THE INVENTION

1. Field of the Invention

The present invention relates to die cast heat treated aluminum silicon based alloys and processes for forming the same.

2. Description of the Prior Art

Alloys which fall within the compositional range of the present invention are known. For example, the commercial alloy A-390 is preferred for use in the present invention.

The heat treatment regimen of the present invention is also known; it is described in Japanese Industrial Standard T6 (hereafter JIS T6).

Further, two step die casting is also known. Such is described in, for example, U.S. Pat. No. 3,106,002 Bauer, hereby incorporated by reference and U.S. Pat. No. 4,380,261 Suzuki et al later discussed.

U.S. Pat. No. 3,664,410 Groteke relates to a metal casting method and apparatus directed to minimizing the formation of voids and improving the quality of cast products. The casting mold is provided with an opening, preferably adjacent to a "hot spot" of the casting space, where the poured metal would be expected to solidify at a relatively slower rate so that some of the molten metal will reach through and beyond the opening and form a metallic nib or projection. The casting equipment is operated to drive a movable rod against the nib to force it through the opening surface and into pressurized contact with the casting material to overcome the voids which would otherwise be produced within the cast product.

U.S. Pat. No. 3,792,726 discloses a metal surface strengthening method comprising attaching, with or without pressure, a preformed plate formed of a metal surface strengthening powder to a molten metal kept in a gas sprayed protective atmosphere in the mold.

U.S. Pat. No. 3,815,663 discloses die casting apparatus of a conventional nature.

U.S. Pat. No. 3,895,941 Bolling deals with aluminum silicon alloys which comprise primary and eutectic silicon simultaneously finely divided and uniformily distributed throughout a casting thereof. The alloys are described as having improved wear resistance, machinability and mechanical properties.

U.S. Pat. No. 4,055,417 Komiyama et al discloses hypereutectic aluminum silicon based alloys for casting. The alloys are characterized as having improved strength, improved machinability and improved wear resistance. The alloys, which are adapted for casting, consist essentially of 16 to 25% silicon, 3.0 to 5.5% copper, 0.2 to 0.8% magnesium, 0.3 to 0.8% manganese, not more than 0.25% of titanium, not more than 0.3% of iron, balance aluminum.

U.S. Pat. No. 4,113,473 Gauvry et al discloses a process for obtaining blanks for extrusion by impact, the blanks being an aluminum alloy containing a large quantity of silicon. The product is indicated to be particularly suitable for manufacturing linings for internal combustion engines.

U.S. Pat. No. 4,347,046 Brucken et al discloses a swash plate compressor of light weight.

U.S. Pat. No. 4,380,261 Suzuki et al discloses a die-casting method in which a molten metal is injected by an injection plunger into a die cavity through an injection passageway and the molten metal injected into the die cavity is squeezed by a squeeze plunger movable through a squeeze passage provided separately from the portion through which the molten metal has been injected into the die cavity. Suzuki et al is also hereby incorporated by reference.

U.S. Pat. No. 3,536,123 Izumi relates to an internal combusion engine cylinder characterized in that it is made of a centrifugally cast high silicon aluminum alloy in which the silicon content is made high in the inside part but low in the outside part. By increasing the content of silicon only on the inside surface wear resistance is improved but by maintaining the silicon content low on the outside surface thermal conductivity and toughness are improved.

U.S. Pat. No. 3,613,768 Awano et al generally deals with a liquid metal forging process comprising pouring liquid metal into a mold, applying high pressure by a punch to the liquid metal through a sealing member where, during pressing, the rim of the sealing member deforms and closely fits the mold to seal the member between the punch and the mold, thereby preventing flash.

SUMMARY OF THE INVENTION

The present invention relates to die cast heat treated aluminum silicon based alloys which provide superior results a compared to prior art alloys when used in an environment where the alloys, in finished form, are subject to sliding surface contact, e.g., in contact with another hard member, e.g., another member having a hardness of HV of at least 50.

The obtaining of the product of the present invention and the process of the present invention are predicated upon the use of certain critically defined alloys, the use of a specific two step die casting process and the use of a specific temperature regimen during heat treating following the two step die casting. The alloy produced according to the present invention has an improved microstructure, i.e., eutectic silicon particles and primary silicon particles are separated out. Unless the alloy, two step die casting and temperature regimen of the present invention are followed, the results of the present invention are not achieved.

One major object of the present invention is to provide heat treated aluminum silicon based alloys and a process for forming the same which provides a product exhibiting excellent wear resistance in areas where the product, in finished form, is subject to sliding surface contact.

DESCRIPTION OF THE PREFERRED EMBODIMENTS

Figure 1:
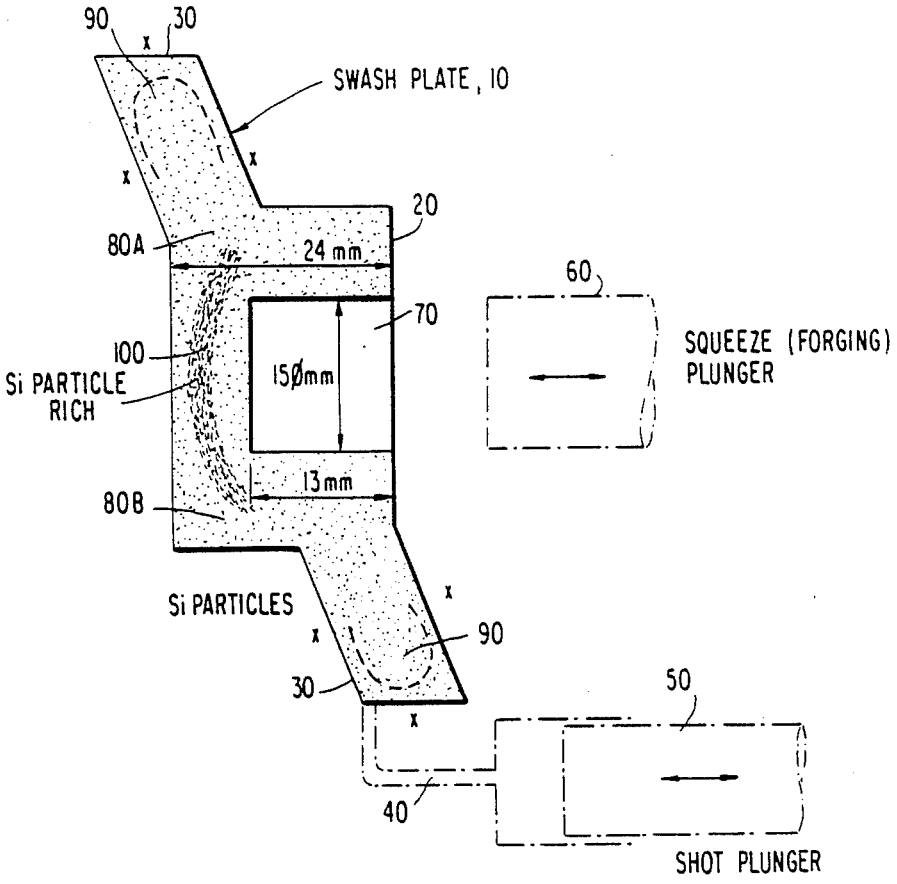
FIG. 1 is a typical swash plate (disk) for a car air conditioner compressor produced in accordance with the present invention; it is not to scale.

The alloys of the present invention consist essentially of 13 to 25 wt % silicon, 2 to 6 wt % copper, up to 1 wt % magnesium, balance aluminum. Unavoidable impurities such as iron, zinc, nickel, manganese, chromium, etc., may also be present.

Preferred alloys according to the present invention consist essentially of 14 to 20 wt % silicon, 3.5 to 5 wt % copper, 0.2 to 1.0 wt % magnesium, balance aluminum, and unavoidable impurities as indicated.

It is most preferred to use 3.5 to 5 wt % copper in combination with 0.4 to 0.7 wt % magnesium. Thus, the use of copper is mandatory per the present invention and the use of copper and magnesium in combination is most preferred since both of these metals strengthen the aluminum matrix.

The aluminum silicon based alloys of the present invention include two kinds of silicon particles, i.e., eutectic silicon particles and primary silicon particles. The primary silicon particles are larger than the eutectic silicon particles and are indefinite/irregular in shape similar to nodular cast iron. The eutectic silicon particles have a spherical shape.

The present invention basically relates to an improvement in the microstructure of the aluminum silicon based alloy. Per the process of the present invention, the microstructure of the alloy produced is improved, i.e., the state of the primary silicon and eutectic silicon in the aluminum matrix is controlled, whereas in a conventional process, silicon is randomly arranged. The size of the primary silicon also becomes smaller than that produced by a conventional process and the shape thereof becomes irregular. In distinction, the primary silicon produced by a conventional process has a regular shape. The state of the primary silicon of the aluminum matrix is similar to the state of graphite in nodular cast iron.

In addition, intermetallic compounds, such as $CuAl_2$, etc., exist in the grain boundary of the aluminum.

The above described microstructure of the alloys of the present invention contributes to improve the character of the alloys of the present invention One major factor in the aluminum alloy of the present invention is the silicon content. At proportions of silicon lower than about 13% it is impossible to obtain primary silicon particles in the pressure die cast product sufficiently, rather, only a eutectic phase results, which will not provide the results of the present invention.

On a commercial scale the process of the present invention used to form the die cast heat treated aluminum silicon based alloys of the present invention will comprise melting the necessary constituents of the alloy, die casting the same using a two step die casting procedure at defined pressures, heat treating the same using a defined temperature regimen, and then machining and optionally sliding surface finishing.

The melting, machining and, if desired or necessary, optional sliding surface finishing steps, are conventional. The present invention will now be described in the context of a typical commercial process.

Most typically the alloy constituents, in ingot form having the desired composition, are melted in a conventional manner. Usually a temperature of from about 760° to about 820° C. is used. One conventional aluminum alloy commercially available for use in the present invention (A-390 as earlier mentioned) consists essentially of 17 wt % silicon, 4.5 wt % copper, 0.5 wt % magnesium, balance aluminum with trace amounts of impurities e.g., less than 0.3 wt % iron. Generally, trace amounts of impurities are acceptable until the same amount to about 2.0 wt %. Other commercially available materials (other than A-390) are available for use within the component ratios of the present invention.

Following melting, the alloy is subjected to pressure die casting in accordance with the present invention. It has been found that unless a two step pressure die casting in accordance with the present invention is used, the objects of the present invention cannot be realized.

By two step pressure die casting is meant that in a first step the molten alloy is injected into the die cavity at the necessary casting pressure, thereby forming a "primary" pressure die cast product before the alloy solidifies completely, whereafter a second squeezing step is conducted.

We wish to emphasize these are two distinct steps which have different purposes as later explained in detail. The first pressure step is primarily an injection of the molten alloy into the die (pressure die casting) and it is hereafter often called a first pressure injection step. The second pressure step is primarily a squeezing of the alloy to achieve the unique effects on the alloy of the present invention later described and it is often simply called a squeezing step.

The first pressure step per the present invention preferably injects the molten alloy slower than a conventional one pressure step so as to substantially prevent air flowing into the die casting. The speed of the first pressure step injection of the present invention is thus slower than a conventional one pressure step die cast (one shot method), and is conveniently from about one-tenth to about one-fifth that of a conventional one pressure step injection. This injects the molten alloy into the die.

The second pressure step or squeezing must be completed, of course, before the alloy solidifies completely. Usually, however, it is initiated at about the time of the beginning of solidification of the molten alloy and can continue to a point just prior to the time the molten alloy is solidified completely.

Thus, the second pressure step typically squeezes or presses at least one portion of a semi-solidified pressure die cast product by way of a squeeze plunger.

The exact time of the first pressure step (injection) and the second pressure step (squeezing) is not overly critical so long as air is substantially prevented from flowing into the die casting during the injection and squeezing is not conducted to the point where the alloy reaches complete solidification.

The second pressure step mainly has two purposes. One is to reduce the proportion of gross porosity as reflected by shrinkage holes. Gross porosity (shrinkage holes) result when the molten mass injected by the first pressure step shrinks during solidification of the molten mass. Gross porosity is especially liable to result just immediately before the molten mass is completely solidified in the case that the speed of a conventional one pressure step injection is slow or the temperature of the molten alloy is high, so that one step injection is completed before the alloy solidifies completely. If the speed of a conventional one step injection is slow, the device used in the conventional one step injection must be heated to prevent the molten alloy from solidifying too quickly. In the present invention, the second pressure step is thus normally conducted (squeezed) when the molten mass is semi-solidified, i.e., between the completely molten state and solidification so that the later stated effects of the second pressure step or squeezing ar achieved. The volume pressed by the second pressure step should be substantially equivalent to the volume of the shrinking due to cooling, whereby the proportion of the gross porosity is remarkably reduced.

Thus, in accordance with the present invention when the second step pressure is applied the molten alloy is not solidified. Actually what happens is that a part of the outer surface of the molten alloy will first solidify and, of course, prior to removal from the die the alloy will be completely solidified. Since the first pressure step injection of the present invention is accomplished at a slower rate than a conventional one step pressure injection, some outer surface solidification may begin but, of course, the second pressure step or squeezing must be done before solidification is complete; the first pressure step injection is basically one which applies generally to the molten alloy. The second pressure step or squeezing is a more localized application to unsolified areas of the alloy to achieve the desired effects discussed herein. In a conventional process, of course, there is no second pressure step or squeezing.

As compared to the present invention, in a conventional one step pressure application method, the squeezing speed cannot be reduced since air would be taken into the die cavity and the proportion of the gross porosity would be increased; as a consequence, the results of the invention could not be achieved using such a conventional method.

Another purpose of the second pressure step is to deform the shape of the microstructure of the silicon before heat treatment. The eutectic particles initially have a needle-like shape. The second pressure step breaks, e.g., one eutectic particle up and divides it into several pieces. Of course, this effect occur with a great number of eutectic particles. The primary silicon particles, on the other hand, have a plate-like and indefinite or irregular shape. During the second pressure step or squeezing, the primary silicon particles are slightly rotated and the corners thereof are broken off or rounded by the second pressure step, since the semi-solidified aluminum alloy contacts the primary silicon paricles with sufficient force to achieve this effect due to the squeezing.

The resulting "deformed" microstructure is improved by the subsequent heat treatment of the present invention. The heat treatment of the present invention may comprise one or two steps. The first heat treatment is essential. The second heat treatment is optional.

The purpose of the first heat treatment is to reform the shape of the eutectic and primary silicon particles deformed in the two pressure step die casting. Due to the heat treatment, the shape of the eutectic silicon particles becomes spherical and the shape of the primary silicon particles becomes nodular-like and indefinite/irregular in shape. Thus, the microstructure of the alloy is improved.

Further, another purpose of the mandatory first or optional second heat treatment relates to the condition of the metal compounds of copper and magnesium in the alluminum alloy. Generally, the above intermetallic compounds (such as $CuAl_2$) are present among the grain boundaries of the aluminum alloy. In the heat treatment of the present invention, the first mandatory heat treatment step puts the intermetallic compounds into the state of a solution in the aluminum matrix. The second optional heat treatment forces the intermetallic compounds in the form of a solid solution to finely distribute the same inside of the same grain of the aluminum. Thus, per the method of the present invention, an improved fine microstructure is obtained.

FIG. 1 shows, in a schematic cross-sectional view, the primary pressure die cast product just after squeezing. The product illustrated is, in this instance, a swash plate (disk) for an automobile air compressor. The present invention finds application, of course, not only for swash plates for use in automobile air conditioner compressors but in other applications where rigorous conditions of sliding surface contact are encountered, for example, as a connecting rod in engines, as a valve rocker arm, a rotor, a cylinder or a side plate of a rotary compressor, a shoe of a compressor, etc.

The present invention should not be construed as limited to the relative silicon enrichment/aluminum enrichment effect discussed herein, though since this is particularly noted in certain instances, however, e.g., in a swash plate as was formed in Example 1, and is often a preferred effect, it is discussed in some detail herein.

In FIG. 1, swash plate 10 is shown comprising main body portion 20 and lateral arms 30.

Swash plate 10 would actually be contained in a die casting mold, the alloy of the present invention being introduced into the mold via line 40 by pressure injection using shot plunger 50.

At this stage, of course, squeezed area 70 as is shown in FIG. 1 does not exist, rather, swash plate 10 is in the form of a homogeneous alloy over its cross-section.

Following primary pressure die casting, squeeze plunger 60 is then used to form zone 70 in swash plate 10.

Since the alloy is contained in the die casting mold, as a consequence of squeezing to form area 70, the volume of the alloy forming swash plate 10 decreases, density simultaneously increases and porosity decreases since the alloy is contained in the die casting mold.

A consequence of the squeezing step, on thicker articles or where only a single second squeezing is used, is that silicon in the aluminum silicon alloy of the present invention is concentrated primarily in the area between 80A and 80B, i.e., in the area substantially along the direction of the squeezing.

On the other hand, since silicon is enriched in the area between 80A and 80B, the aluminum content is enriched in other areas of swash plate 10, most generally in those areas most remote the direction of squeezing, in this instance areas 90, the areas which are subject to surface wear contact.

This effect of the present invention is most pronounced with a shape as indicated in FIG. 1, i.e., where the main body of swash plate 10 has protruding therefrom laterally extending arms 30; in this particular instance, since arms 30 are relatively remote from the area 100 where silicon concentration is most pronounced (in the direction of squeezing), the effect of relative aluminum enrichment in areas 90 is most pronounced.

In more detail, in the pressure die casting step of the present invention the molten aluminum silicon alloy is injected into the die cavity at a casting pressure of about 450 to about 500 $kg/cm^2$, thereby forming a primary pressure die cast product.

It is to be specifically noted that during the pressure die casting of the present invention all aluminum silicon alloy which is introduced into the die cavity is retained therein but, due to the second squeezing step, the total volume that the aluminum silicon alloy occupies is decreased by the amount of the squeeze plunge. This contributes to reduced porosity and increased density.

Following pressure die casting, which results in a relatively homogeneous aluminum silicon alloy product over the entire cross-section of the product, the secondary squeezing step of the present invention is practiced.

Normally the pressure of squeezing step is about 80 to about 150 kg/cm$^2$.

The interval between the completion of pressure die casting and the initiation of squeezing is normally from about 1 to about 9 seconds, preferably from about 3 to about 9 seconds, and will vary depending on the temperature of the die casting mold utilized and the temperature of the molten metal. The interval is short in the case that the product is small and the interval is long in case that the product is large. If the interval is too long, the alloy is solidified completely before the squeeze plunge begins. If the interval is too short, the squeeze plunge is performed into completely molten alloy.

For reasons which are not entirely clear, if the aluminum silicon alloy of the present invention is pressure die cast using a "one shot" conventional procedure, air diffuses out of the cast part and heat treatment essentially becomes impossible; as a consequence the product is easily broken and holes (gross porosity) appear on the surface of the product.

Thus, it is necessary to use a two step pressure die casting in accordance with the present invention due to out-gassing problems which are encountered with a one shot pressure die casting in accordance with the prior art.

The cast product is then ejected from the die casting unit in a conventional manner.

As one skilled in the art will easily appreciate, the time that the die cast material is subjected to the primary casting pressure is variable and depends on product size. Normally it is just for a few seconds and can easily be determined by one skilled in the art, noting as earlier explained it is preferably slower than a conventional "one shot" die cast.

In a similar fashion, the time that the squeezing pressure is applied is also relatively unimportant and again is normally for only a few seconds so long as it is not applied to the point of complete solidification. Usually it begins after some surface solidification has begun since the first pressure injection is relatively slow.

It is important, however, that the pressure during the pressure die casting squeezing steps be within the ranges as earlier given.

Following the two step die casting, the heat treatment regimen of the present invention is followed. The heat treatment regimen of the present invention is basically in accordance with JIS T6. For purposes of discussion, the intermediate pressure die cast product will merely be referred to as "the product".

The product is first heated to a temperature of about 460° to about 520° C. for about 2 to about 10 hours.

Following the above heating, the product is then typically rapidly cooled, for example, by quenching in water.

The product is then optionally subjected to a second heating at about 140 to about 220° C. for about 0.5 to about 10 hours, and then permitted to cool, e.g., in the air.

The above is the currently most preferred temperature profile cycling per the present invention. The first temperature cycle at about 460° C. to about 520° C. for from about 2 to about 10 hours followed by quenching is mandatory; the second heat temperature cycling at about 140° to about 220° C. for about onehalf hour to about 10 hours is optional, but highly preferred.

Following processing as above, machining and, if desired or necessary, sliding surface contact finishing can be conducted.

In both heat treating steps we normally use air as the atmosphere, but other atmospheres can be used.

It is to be specifically noted that the time of temperature elevation to the first mandatory heating is not important, rather, what is important is heating at the defined temperature for the defined time.

Similarly, the time of temperature elevation to the second optional heating is not overly important and can be freely varied; when used, however, it is most preferred to follow the above temperature/time regimen for the second optional heating step.

Finally, the time of cooling, typically in air, is not important and normally air cooling is just permitted after the second optimal heating to proceed at ambient temperature.

It is important, however, to rapidly quench the product after the first heating step. Conveniently this is done by rapid immersion in water, i.e., by immersing the product at a temperature substantially within the range of from about 460° to about 520° C. in water; other alternative procedures can be used, however, as will be apparent to one skilled in the art.

The prior art has not suspected that by the combined use of alloys as claimed herein in combination with a two step pressure die casting as claimed herein further in combination with a heat treatment as claimed herein that the unique results of the present invention would be obtained.

An important factor in accordance with the present invention is the size of the primary silicon particles which are formed in the alloy. We have found that unless squeezing is practiced, the results of the present invention are not achieved. Accordingly, we believe that the squeezing or secondary pressure die casting is critical to achieve the results of the present invention insofar as the primary silicon particle size is concerned.

An important factor to further consider is the total volume of aluminum silicon alloy which is displaced during the secondary pressure die casting step, i.e., with reference to FIG. 1, the total volume of space 70 which is displaced by plunger 60.

Normally, we have found that for preferred results this should represent about 1.5 to about 3% of the total volume of the product following primary pressure die casting and squeezing casting. This is especially important to achieve the preferred relative silicon particle enrichment and preferred aluminum alloy enrichment.

For instance, with reference to FIG. 1, area 100 will have about three times the amount of silicon particles as area 90, i.e., taking the number of silicon particles in area 90 as 1, the number of silicon particles in area 100 would about about 3. This is merely illustrative, of course, and this ratio can vary widely.

For example, to achieve the desired relative silicon particle enrichment and desired aluminum enrichment as shown in FIG. 1, the total volume of the material displaced was 2.5%, basis as earlier given.

As a general rule, the concentration of silicon particles in a line along the direction of secondary pressure die casting is increased about 200 to about 300% as compared to the silicon particle content in the balance of the product.

The importance of the above factors will be explained with respect to FIGS. 2 through 6. In all instances, the aluminum silicon alloy was (hereafter all percentages are weight percentages based on total alloy weight, unless otherwise indicated) 17% silicon, 4.5% copper, 0.5% magnesium, 0.3% iron, balance aluminum and unavoidable trace impurities.

Discussion will be between an aluminum silicon alloy product formed in accordance with the present invention, comparison (1) which is a product formed from the same aluminum silicon alloy by continuous casting and forging using a heat treatment in accordance with the present invention (JIS T6) and comparison (2) which is a die cast material formed from an alloy as earlier identified using a conventional die casting process, i.e., without following the heat regimen of the present invention.

The summary of the major differences between the present invention and between comparison (1) and comparison (2) is given in Table A below, with a comparison further to U.S. Pat. No. 3,106,002 Bauer and U.S. Pat. No. 4,380,261 Suzuki et al being presented in Table B.

TABLE A

| | Present Invention | Comparison (1) Continuous casting | Comparison (2) Die Casting |
|---|---|---|---|
| 1. alloy | Al—Si—Cu—Mg—others (A390) 13 2 0.2 25 6 1.0 | Al—Si—Cu—Mg—others (A390) 13 2 0.2 25 6 1.0 | Al—Si—Cu—Mg—others (A390) 12 2 0.2 25 6 1.0 |
| 2. Shape of Eutectic Si particles | spherical | spherical | needle-like |
| 3. Shape of Primary Si particles | indefinite/ irregular | definite/ regular | indefinite/ regular |
| 3'. Size of Primary Si particles | smaller than 40 millimicrons | bigger than 40 millimicrons | smaller than 40 millimicrons |
| 4. Hardness of Matrix (Hv) | 120–185 | 140–160 | 60–120 |
| 5. Holes (gross porosity) | substantially non-existant | substantially non-existant | present to a great degree |

TABLE B

| | Present Invention | Comparison (1) | Comparison (2) | Bauer | Suzuki |
|---|---|---|---|---|---|
| Casting | die casting shot + squeeze | continuous casting | conventional die cast | die casting shot + squeeze | improved shot + squeeze |
| Heat Treatment | T6 (460–520° C.) (140–220° C.) | T6 | not applied (except for a low temperature treatment) | | |

All of the above information regarding the present invention does, of course, apply to the present invention and it is to be specifically noted that the silicon particles have a size smaller than 40 micrometers.

Turning now to a discussion of FIG. 2 to FIG. 6, in each of these FIGURES the white or light colored background area is the aluminum matrix and the dark area is the silicon.

Figure 2:
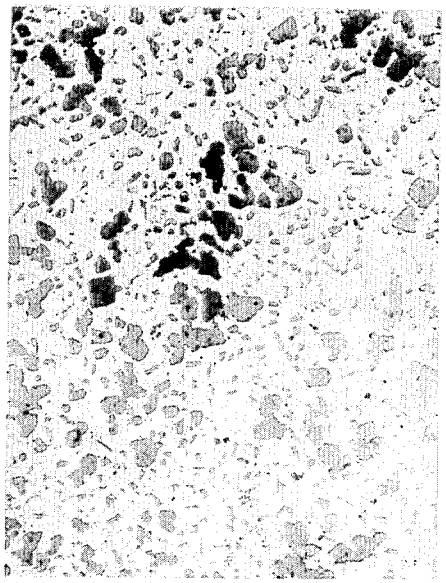
FIGS. 2 to 6 are microphotographs of alloys produced in accordance with the present invention and in accordance with processes outside the invention.
Figure 3:
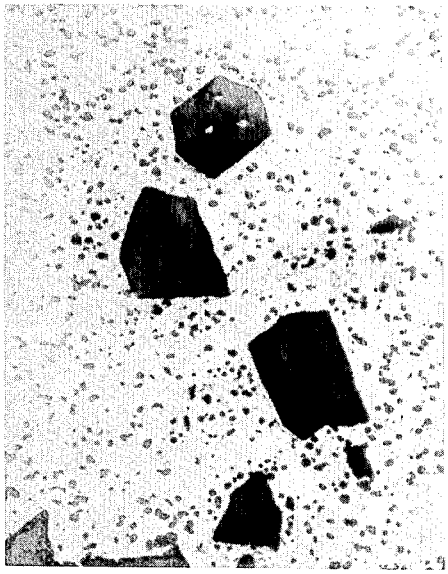
Figure 4:
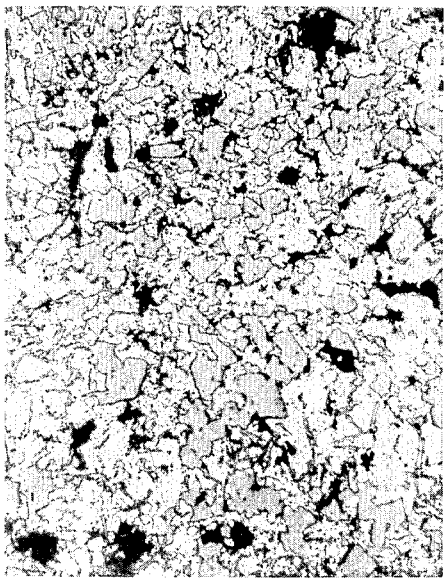
Figure 5:
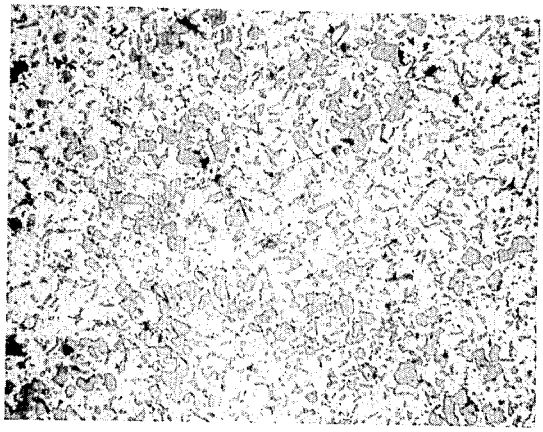
Figure 6:
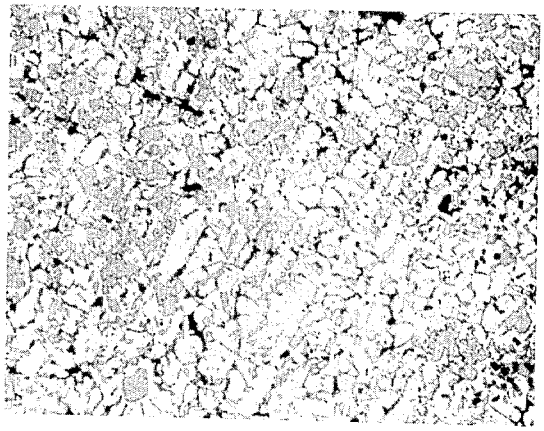

In each of FIGS. 2 to 4, the magnification was 400 X and in FIGS. 5 and 6 the magnification was 200 X.

Each of FIGS. 2–6 are cross-sections; as a consequence, the view is only two dimensional.

FIG. 2 is a microphotograph of a die cast heat treated aluminum silicon alloy in accordance with the present invention. The hardness of the aluminum matrix was HV 120–180. The primary silicon particles had a size of 20 μm. The primary silicon particles in FIG. 2 are the larger gray silicon particles; they are irregular in shape, i.e., they vary in size, shape and volume three dimensionally. The maximum dimension of the primary silicon particles is less than 40 millimicrons. The eutectic silicon particles are the smaller, and generally lighter in color, particles which are essentially spherical in shape when viewed three dimensionally. Substantially all of the primary silicon particles are greater in size and volume than the eutectic silicon particles and the majority of the eutectic silicon particles have a size less than 5 millimicrons. The die cast heat treated alloy in accordance with the present invention should exhibit an aluminum matrix hardness of HV of from 120 to 185, preferably 130 to 185 and most preferably 140 to 185.

It is especially important to recognize the complete absence of "holes", i.e., the extremely low porosity of the die cast heat treated aluminum silicon alloy obtained in accordance with the present invention.

FIG. 3 is a microphotograph of a comparison aluminum alloy formed in accordance with comparison (1) earlier described. The hardness of the aluminum matrix was HV 140–160. The size of the primary silicon particles was about 55 μm, and the shape of the primary silicon particles was crystal-like. As opposed to the primary silicon particles of the present invention which are irregular in shape, the primary silicon particles seen in FIG. 3 are regular and have a size larger than 40 millimicrons. The reason for this is that in accordance with FIG. 3 the product is formed by a process which involves a slow cooling procedure whereas per the present invention a quenching step is mandatory. By crystal-like is meant that three dimensionally the primary silicon particles shown in FIG. 3 are octarhombahedral, i.e., have a shape similar to two pyramids joined together. The eutectic silicon particles were spherical in shape.

The major benefit of the product in accordance with the present invention as compared to comparison (1) is that large crystals as are shown in FIG. 3 and as are present in a product in accordance with comparison (1) do not slide smoothly, i.e., small primary silicon particles in accordance with the present invention are desirable. Also, under high loads small primary silicon particles per the present invention provide greater strength to the product. Further, irregular primary silicon particles per the present invention as compared to regular primary silicon particles as shown in FIG. 3 are superior since regular primary silicon particles quickly provide a cutting surface, leading to increased wear. The product of FIG. 3 did have relatively porosity, however.

FIG. 4 is a microphotograph of a comparison aluminum alloy formed in accordance with comparison (2) earlier described. The hardness of the aluminum matrix was HV 100–120, the maximum value of which barely met the minimum expected per the present invention. The primary silicon particles had a size smaller than 40 millimicrons, typically on the order of 20 millimicrons. The primary silicon particles were irregular in shape; however, the eutectic silicon particles were needle-like in shape, i.e., the long axis thereof was greater than the short axis, typically the long axis being three or more times the dimension of the short axis. Needle-like eutectic silicon particles have sharp ends and provide a poor sliding surface. The T6 heat treatment in accordance with the present invention is needed to convert needle-like eutectic silicon particles into a spherical shape as is the case with the present invention. Gross porosity is also seen in FIG. 4, i.e., porosity visible at 400 X magnification. This greatly reduces the mechanical properties of the aluminum matrix, especially flexural strength and elongation, rendering the product of FIG. 4 substantially inferior to that of the present invention.

FIGS. 5 and 6 (200 X magnification) are microphotographs of a die cast heat treated alloy produced in accordance with the present invention (FIG. 5) and a product produced in accordance with comparison (2) (FIG. 6). These two figures represent a comparison of the aluminum matrix microstructure obtained.

Reference to FIG. 5 shows that in accordance with the present invention copper and/or magnesium, e.g., as $CuAl_2$, has essentially completely melted into the aluminum alloy and there are relatively few particles of $CuAl_2$ along the aluminum grain boundary.

In distinction, as is easily seen in FIG. 6, the $CuAl_2$ is highly visible as small black dots on the aluminum grain boundary (the large black area at the bottom left of FIG. 6 is gross porosity), indicating that the same has not been melted into the aluminum alloy and does not provide what can be considered essentially a homogeneous alloy of aluminum with substantially no $CuAl_2$ present along the aluminum grain boundary. This particular effect of the present invention is due to the heat treatment of the present invention.

The presence of the $CuAl_2$ arrangement shown in FIG. 5 is the key to the excellent mechanical strength obtained per the present invention; if, as shown in FIG. 6, the $CuAl_2$ is between the aluminum grains, i.e., at the grain boundary, the $CuAl_2$ is easily broken and a product as shown in FIG. 6 easily cracks at areas of major $CuAl_2$ concentration. As shown in FIG. 5, the $CuAl_2$ has a size on the order of about 50 to about 100 Å, but has a much greater size in FIG. 6.

Various die cast heat treated aluminum silicon alloys were prepared in accordance with the present invention and as comparisons the following comparison (1) and comparison (2)—both as earlier explained—and other comparisons are presented. These are set forth in the following Table. The heading "shoe" represents the type of shoe in sliding contact with the swash plate, i.e., subjected to boronized surface treatment in a conventional manner, a conventional steel shoe or a conventional powder shoe (sintered steel).

TABLE C

| Sample | Material wt % | | | | Shoe | | | Seizure |
|---|---|---|---|---|---|---|---|---|
| No. | Al | Si | Cu | Mg | Boronized | Steel | Powder | Load* |
| | | | | The Present Invention | | | | |
| 1 | Bal | 13 | 6.0 | 0.6 | 0 | | | 340 |
| 2 | " | 13 | 5.0 | 0.4 | | 0 | | 250 |
| 3 | " | 13 | 2.0 | 0.5 | | | 0 | 160 |
| 4 | " | 14 | 2.0 | 0.9 | 0 | | | 350 |
| 5 | " | 14 | 2.0 | 0.6 | | 0 | | 320 |
| 6 | " | 14 | 5.0 | 0.2 | | | 0 | 190 |
| 7 | " | 17 | 5.0 | 0 | 0 | | | 370 |
| 8 | " | 17 | 4.5 | 0.5 | | 0 | | 330 |
| 9 | " | 17 | 4.5 | 0.5 | | | 0 | 200 |
| 10 | " | 20 | 4.0 | 0.4 | 0 | | | 450 |
| 11 | " | 20 | 4.0 | 0.3 | | 0 | | 300 |
| 12 | " | 20 | 3.5 | 0.7 | | | 0 | 200 |
| 13 | " | 21 | 3.8 | 0.3 | 0 | | | 450 |
| 14 | " | 21 | 3.5 | 0.5 | | 0 | | 300 |
| 15 | " | 21 | 3.5 | 0 | | | 0 | 200 |
| 16 | " | 25 | 3.0 | 0.4 | 0 | | | 400 |
| 17 | " | 25 | 3.0 | 0.4 | | 0 | | 200 |
| 18 | " | 25 | 3.0 | 0.3 | | | 0 | 150 |
| | | | | Comparison (1) | | | | |
| 19 | " | 17 | 4.5 | 0.5 | 0 | | | 290 |
| 20 | " | 17 | 4.0 | 0.8 | | 0 | | 170 |
| 21 | " | 17 | 5.0 | 0.3 | | | 0 | 130 |
| | | | | Comparison (2) | | | | |
| 22 | " | 17 | 3.5 | 0.7 | 0 | | | 230 |
| 23 | " | 17 | 4.5 | 0.4 | | 0 | | 110 |
| 24 | " | 17 | 5.5 | 0.6 | | | 0 | 100 |
| | | | | Comparison (3), (4), etc. | | | | |
| 25 | " | 10 | 0.5 | 0.1 | 0 | | | 200 |
| 26 | " | 10 | 1.0 | 0.1 | | 0 | | 100 |
| 27 | " | 10 | 1.2 | 0.2 | | | 0 | 100 |
| 28 | " | 28 | 0.5 | 0.1 | 0 | | | 280 |
| 29 | " | 28 | 1.0 | 0.1 | | 0 | | 100 |
| 30 | " | 28 | 1.0 | 0.2 | | | 0 | 60 |

*kg

Having thus generally described the invention, the following currently best modes of practicing the invention are given.

EXAMPLE 1

In this Example, a conventional swash plate as shown in FIG. 1 was formed.

The alloy selected was 17% silicon, 4.5% copper, 0.5% magnesium, 0.3% iron, balance aluminum and less than 0.3 wt % iron as part of the trace amounts of impurities.

The alloy, in ingot form, was melted in a conventional melting pot at a temperature of 790° C. using a conventional phosphor flux.

The alloy was then cast into a casting die as shown in U.S. Pat. No. 4,380,261 Suzuki et al where the mold has a shape as shown in FIG. 1. A casting dye as disclosed in U.S. Pat. No. 3,106,002 Bauer can also be used with equal success. The alloy was cast at a primary pressure die casting pressure of 450 $Kg/cm^2$ using a shot plunger. The primary pressure die casting pressure was maintained for 0.2 seconds whereafter it was removed. After an interval of 4 seconds, secondary pressure die casting squeezing was conducted at a pressure of 160 Kg/cm$^2$. The time was merely for a few seconds, whereafter the squeeze plunger was removed. With reference to FIG. 1, main body 20 of the swash plate comprised about 30 vol % of the swash plate and radial arms 30 of the swash plate comprised about 70 vol % of the swash plate. The amount of volume percentage will, of course, depend on the objects of the die casting, that is, the shape (boss), etc. Plunger 60 was introduced to a depth sufficient to displace about 2.5 vol % of the swash plate, resulting in a silicon particle rich area directly in front of the path of travel of the squeeze plunger about 3 times (numerical) that of the silicon particles in area 90 of the arms of the swash plate.

The swash plate at this stage was then removed from the die in a conventional manner.

Subsequent to primary and secondary pressure die casting, the product was permitted to cool at room temperature (this is optional) and then raised to a temperature of 510° C. by heating in a conventional furnace in air and maintained at that temperature for 6 hours. Following heating at the above conditions, the product was removed from the furnace at the temperature of heating and immediately quenched in water maintained at 40° C.

Following water quenching, the product was heated to 190° C., again in a conventional furnace in air, and maintained at that temperature for 5 hours.

The product was then removed from the second furnace and permitted to cool to ambient in the air.

Following processing as above, the swash plate intermediate was subjected to conventional machining and sliding surface finishing operations.

While there have been described what are at present considered to be the preferred embodiments of this invention, it will be obvious to those skilled in the art that various changes and modifications can be made therein without departing from the invention, and it is, therefore, intended to cover all such changes and modifications as fall within the true spirit and scope of the invention.

What is claimed is:

1. A heat treated shaped aluminum silicon alloy sliding material containing primary silicon particles consisting essentially of, based on alloy weight, from 13 to 25 wt % silicon, from 2 to 6 wt % copper, up to 1 wt % magnesium, balance aluminum, said heat treated alloy being formed by the process comprising:

subjecting said alloy while in molten condition to a primary pressure die casting at a casting pressure of from about 450 to about 500 kg/cm$^2$ to form a primary pressure die cast product with a molten central phase and a solidified peripheral phase which includes said primary silicon particles having sharp edges;

prior to the time said aluminum silicon alloy completely solidifies said alloy having an initial volume, subjecting said primary pressure die cast alloy to a secondary pressure die casting for dulling the edges of said primary silicon particles by moving said primary silicon particles slightly in the alloy so as to reduce said initial volume thereof partially from about 1.5 to about 3% and cooling said primary pressure die casting alloy under the secondary pressure to form a secondary pressure product which is wholly solidified and caused to have primary silicon particles in the central phase thereof;

heating the thus treated said secondary pressure product which contains said dulled primary silicon particles to a temperature of from about 460° C. to about 520° C. for a period of time of from about 2 to about 10 hours to form a heat-treated product which includes the primary silicon particles with a nodular-like shape; and rapidly quenching said product to produce said article.

2. The sliding material of claim 1, wherein said sliding material consists essentially of said alloy which is in the form of an aluminum matrix containing primary silicon particles which are irregular in shape and have a maximum dimension less than 40 millimicrons and eutectic silicon particles which are substantially spherical in shape.

3. The sliding material of claim 1, wherein said sliding material has an Hv hardness of 120 to 185.

4. The sliding material of claim 1, wherein said sliding material is substantially non-porous.

5. The sliding material of claim 1, wherein said secondary pressure die casting provides an area of increased silicon particles along the line of application of secondary pressure die casting as compared to areas of the aluminum silicon alloy not along the line of application of secondary pressure die casting.

6. A process for producing a heat treated shaped aluminum silicon alloy sliding material containing primary silicon particles consisting essentially of, based on alloy weight, from 13 to 25 wt % silicon, from 2 to 6 wt % copper, up to 1 wt % magnesium, balance aluminum, said heat treated alloy being formed by the process comprising:

subjecting said alloy while in molten condition to a primary pressure die casting at a casting pressure of from about 450 to about 500 kg/cm$^2$ to form a primary pressure die cast product with a molten central phase and a solidified peripheral phase which includes said primary silicon particles having sharp edges;

prior to the time said aluminum silicon alloy completely solidifies said alloy having an initial volume, subjecting said primary pressure die cast alloy to a secondary pressure die casting for dulling the edges of said primary silicon particles by moving said primary silicon particles slightly in the alloy so as to reduce said initial volume thereof partially from about 1.5 to about 3% and cooling said primary pressure die casting alloy under the secondary pressure to form a secondary pressure product which is wholly solidified and caused to have primary silicon particles in the central phase thereof;

heating the thus treated said secondary pressure product which contains said dulled primary silicon particles to a temperature of from about 460° C. to about 520° C. for a period of time of from about 2 to about 10 hours to form a heat-treated product which includes the primary silicon particles with a nodular-like shape; and rapidly quenching said product to produce said article.

7. The process of claim 6, wherein said article consists essentially of an aluminum matrix containing primary silicon particles which are irregular in shape and eutectic silicon particles.

8. The process of claim 7, wherein said eutectic silicon particles are substantially spherical in shape.

9. The process of claim 7, wherein said primary silicon particles have a size less than 40 micrometers.

10. The process of claim 7, wherein said secondary pressure die casting results in an area of increased silicon particles along the line of application of secondary pressure die casting as compared to areas of the aluminum silicon alloy not along the line of application of secondary pressure die casting.

11. In the combination of two materials in sliding surface contact wherein one material has a hardness Hv of at least 50, the improvement where the other of said materials is a heat treated shaped aluminum silicon alloy sliding material containing primary silicon particles consisting essentially of, based on alloy weight, from 13 to 25 wt % silicon, from 2 to 6 wt % copper, up to 1 wt % magnesium, balance aluminum, said heat treated alloy being formed by the process comprising:

subjecting said alloy while in molten condition to a primary pressure die casting at a casting pressure of from about 450 to about 500 kg/cm$^2$ to form a primary pressure die cast product with a molten central phase and a solidified peripheral phase which includes said primary silicon particles having sharp edges;

prior to the time said aluminum silicon alloy completely solidifies said alloy having an initial volume, subjecting said primary pressure die cast alloy to a secondary pressure die casting for dulling the edges of said primary silicon particles by moving said primary silicon particles slightly in the alloy so as to reduce said initial volume thereof partially from about 1.5 to about 3% and cooling said primary pressure die casting alloy under the secondary pressure to form a secondary pressure product which is wholly solidified and caused to have primary silicon particles in the central phase thereof;

heating the thus treated said secondary pressure product which contains said dulled primary silicon particles to a temperature of from about 460° C. to about 520° C. for a period of time of from about 2 to about 10 hours to form a heat-treated product which includes the primary silicon particles with a nodular-like shape; and rapidly quenching said product to produce said article.

12. The combination of claim 11, wherein said sliding material consists essentially of said alloy which is in the form of an aluminum matrix containing primary silicon particles which are irregular in shape and have a maximum dimension less than 40 millimicrons and eutectic silicon particles which are substantially spherical in shape.

13. The combination of claim 11, wherein said sliding material has an Hv hardness of 120 to 185.

14. The combination of claim 11, wherein said sliding material is substantially non-porous.

15. The combination of claim 11, wherein said secondary pressure die casting provides an aluminum matrix containing primary silicon particles which are irregular in shape and eutectic silicon particles.

16. The combination of claim 11, wherein said secondary pressure die casting results in an area of increased silicon particles along the line of application of secondary pressure die casting as compared to areas of the aluminum silicon alloy not along the line of application of secondary pressure die casting.

* * * * *